US007292698B2

(12) United States Patent
Niederdränk et al.

(10) Patent No.: US 7,292,698 B2
(45) Date of Patent: Nov. 6, 2007

(54) DATA TRANSMISSION DEVICE FOR HEARING AIDS

(75) Inventors: Torsten Niederdränk, Erlangen (DE); Gerhard Pfannenmüller, Oberasbach (DE); Gottfried Rückerl, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 370 days.

(21) Appl. No.: 10/777,241

(22) Filed: Feb. 12, 2004

(65) Prior Publication Data

US 2004/0175009 A1 Sep. 9, 2004

(30) Foreign Application Priority Data

Feb. 12, 2003 (DE) ..... 103 05 833

(51) Int. Cl.
*H04R 25/00* (2006.01)

(52) U.S. Cl. ..... 381/315; 455/3.06

(58) Field of Classification Search ..... 381/315; 331/117 FE

See application file for complete search history.

(56) References Cited

U.S. PATENT DOCUMENTS

| | | | | |
|---|---|---|---|---|
| 4,543,953 | A | 10/1985 | Slocum et al. | |
| 5,159,293 | A | 10/1992 | Pulice | |
| 5,638,031 | A | 6/1997 | Danstrom | |
| 5,721,783 | A * | 2/1998 | Anderson | 381/212 |
| 5,812,598 | A | 9/1998 | Sharma et al. | |
| 6,118,378 | A * | 9/2000 | Balch et al. | 340/572.7 |
| 6,828,868 | B2 * | 12/2004 | Sano | 331/117 FE |
| 2002/0091337 | A1 | 7/2002 | Adams et al. | |
| 2002/0165584 | A1 | 11/2002 | Moore | |
| 2002/0191806 | A1 | 12/2002 | Rohrseitz | |

FOREIGN PATENT DOCUMENTS

| | | | |
|---|---|---|---|
| DE | 101 15 896 | A1 | 11/2002 |
| EP | 1 231 819 | A2 | 8/2002 |
| JP | 1226217 | | 9/1989 |
| JP | 10-247839 | A | 9/1998 |
| JP | 2002010396 | | 1/2002 |
| SU | 1192105 | A | 11/1985 |
| WO | WO8905067 | | 6/1989 |
| WO | WO9641498 | | 12/1996 |

* cited by examiner

*Primary Examiner*—Daniel Swerdlow
(74) *Attorney, Agent, or Firm*—Schiff Hardin LLP

(57) ABSTRACT

The communication device in a hearing aid needs to be optimized with respect to spatial requirements and power consumption. To this end, provision is made for an inductor in an oscillator circuit to be used simultaneously as an antenna. Besides reducing the number of components, this also reduces the power consumption. Further optimization in terms of energy can be achieved by virtue of a comparator being used to actuate a controllable current source such that energy is fed into the oscillator circuit only during a half-cycle.

9 Claims, 2 Drawing Sheets

DATA TRANSMISSION DEVICE FOR HEARING AIDS

BACKGROUND OF THE INVENTION

The present invention relates to a data transmission device for hearing aids having a modulatable oscillator circuit for generating an alterable transmission signal and an antenna device for radiating the transmission signal.

Wireless data transmission between hearing aids or between a hearing aid and a remote control unit necessitates that the hearing aid or the hearing aids have a modulatable transmission oscillator which it should be possible to integrate into the respective hearing aid's integrated circuit. For the transmission devices in hearing aids, however, there are very specific constraints. First, there is the small amount of available space, particularly in in-ear hearing aids, and secondly, there is a very small available current for supplying the transmitter, which is usually in the region of microamps. Another constraint is the high frequency stability required for transmission, which can usually be achieved only with a crystal oscillator.

To date, these constraints have been able to be observed only by amplitude-modulated transmitters in hearing aids, so as to ensure, by way of example, "cross" and "bi-cross" transmissions between hearing aids. For the transmitters, popular standard oscillator circuits have been used. A drawback of these standard circuits is the high power consumption and also the use of a relatively voluminous crystal oscillator as the frequency standard.

In this connection, the printed German patent document DE 101 15 896 discloses a hearing aid system having a programmable hearing aid and a transmission and reception unit. For the purpose of wireless programming, the hearing aid is provided with a transmission and reception unit which is detachably connected to the hearing aid. This transmission and reception unit preferably has the external shape of a hearing aid battery and can be inserted into the hearing aid's battery compartment for the purpose of programming. This means that components which are required for wirelessly programming the hearing aid are connected to the hearing aid only during programming. While the hearing aid is being programmed, data are provided in an external programming unit and are transmitted using a transmission and reception coil in the form of electromagnetic waves to a separate transmission and reception coil associated with the hearing aid.

SUMMARY OF THE INVENTION

The object of the present invention is thus to provide a data transmission device for hearing aids which has a low space requirement and low power consumption.

The invention achieves this object with a data transmission device for hearing aids having a modulatable oscillator circuit for generating an alterable transmission signal and an antenna device for radiating the transmission signal, where the oscillator circuit comprises a coil device which is used as a transmission and reception antenna device.

Various embodiments of the invention are discussed below. Since an LC resonant circuit can be used as the transmission oscillator instead of a crystal oscillator, the small volume of the LC resonant circuit allows it to be accommodated, at least in part, in the hearing aid's integrated circuit. If the resonant circuit has a high quality factor, the transmitter can be operated very efficiently. This is advantageous particularly because the transmission oscillator in the hearing aid can be operated at a very low supply voltage, in which case the amplitude of the transmission voltage should utilize the available range as far as possible. This allows a relatively large proportion of the power supplied to the resonant circuit to be radiated, which means that a high level of efficiency can be attained.

Advantageously, the data transmission device has an actuation circuit which feeds an adjustable amount of energy into the oscillator circuit exclusively during a negative or positive half-cycle of the oscillation in the oscillator circuit. This allows better utilization of the limited battery capacity. This half-cycle feed can be implemented particularly advantageously using a current mirror which is actuated by a comparator circuit which monitors the polarity of the oscillation. In this case, the current mirror can preferably be used to control the transmission power which is to be output and the oscillation amplitude.

Advantageously, the data transmission device contains a modulator circuit, which is connected to the oscillator circuit and comprises a connectable capacitor element, for frequency modulating the oscillation in the oscillator circuit. This connectable capacitor element has a very low space requirement and may be integrated on the IC if appropriate. This design also readily ensures that amplitude modulation of the signal which is to be radiated is carried out.

To trim the resonant frequency of the oscillator circuit, a trimming device which is connected to the oscillator circuit can be provided. The purpose of this is to set the resonant frequency, which may differ from the nominal value on account of component tolerances, by connecting or disconnecting capacitance elements.

DESCRIPTION OF THE DRAWINGS

The present invention is now explained in more detail with reference to the appended drawings, in which.

DETAILED DESCRIPTION OF THE PREFERRED EMBODIMENTS

The exemplary embodiments which follow represent preferred embodiments of the present invention.

Figure 1:
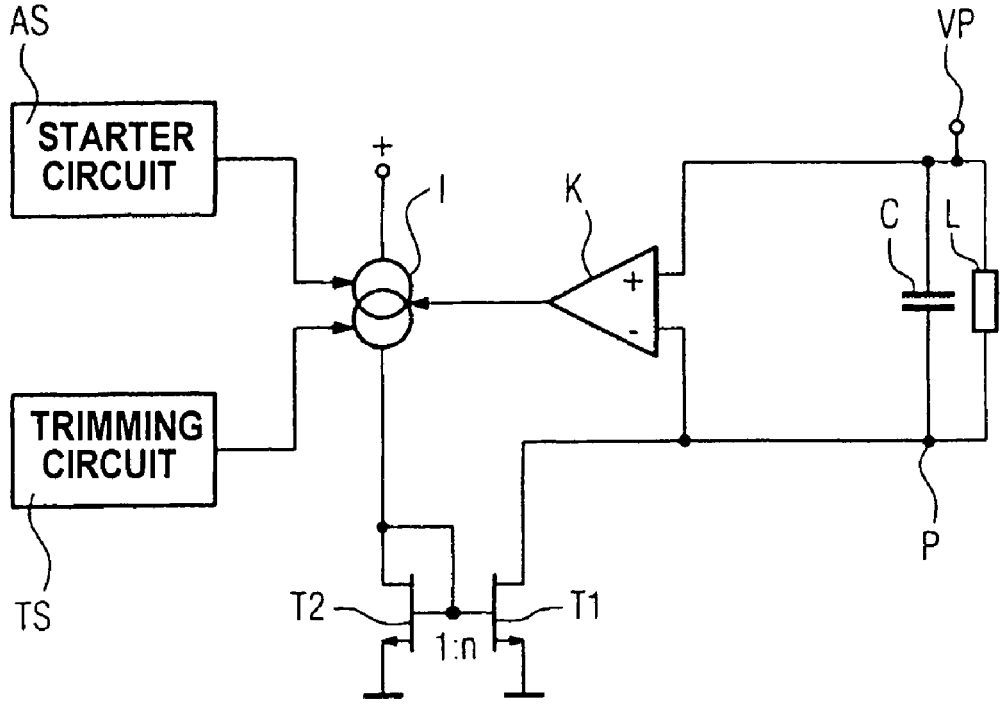
FIG. 1 is a block circuit diagram showing a transmission oscillator based on an embodiment of the invention.

In a first inventive embodiment in line with FIG. 1, the transmission oscillator is formed by a parallel LC resonant circuit. A terminal in the parallel resonant circuit LC is supplied with a fixed potential VP, which is a DC potential which is, by way of example, directly equivalent to the supply or battery voltage or else can be derived from a voltage multiplier circuit which may be present.

The second terminal P in the parallel resonant circuit LC is in the form of a freewheeling pole. A comparator K monitors the freewheeling pole P with respect to the supply potential VP. The output signal from the comparator K is used to control a controllable current source I. The current source I is connected between a supply terminal + and a current mirror which is formed from two field-effect transistors T1, T2 and is used for decoupling and impedance matching the oscillator circuit LC.

The first field-effect transistor T1 in the current mirror has its drain connected to one input of the comparator K or to the freewheeling pole P. The source of the transistor T1 is connected to ground. The gate of the field-effect transistor T1 is connected to the gate of the second field-effect transistor T2 in the current mirror. The gate and drain of the second field-effect transistor T2 are likewise connected to one another. The source of the field-effect transistor T2 is in turn connected to ground. The drain of the field-effect transistor T2 is connected to the controllable current source I. The controllable current source I receives further control signals from a starter circuit AS and a trimming circuit TS.

The comparator K monitors the freewheeling pole P of the LC resonant circuit. For levels which are smaller than the fixed quiescent potential VP, it activates the current mirror. Otherwise it turns off the current mirror. The oscillation thus experiences positive feedback during the negative half-cycle. During the positive half-cycle, the energy in the resonant circuit LC is used to maintain the oscillation.

The resonant frequency is determined by the resonance of the LC resonant circuit and can thus be stipulated by a suitable selection of L and C.

The power injected into the resonant circuit LC is directly proportional to the current which the current mirror T1, T2 supplies. It is thus a simple matter to control the transmission amplitude by prescribing the supplied current. In an integrated circuit, suitable constant currents are available for this purpose, and these can be set using conventional measures. A suitable selection of the current mirror's mirror ratio n:1 means that the current mirror's actuation current can be smaller than the current delivered to the resonant circuit by the factor n. The maximum transmission amplitude which can be reached is the voltage VP. The available voltage range is thus utilized in optimum fashion.

Control of the supplied current not only allows the transmission amplitude to be aligned but also allows the current drawn from the battery to be limited in precise fashion. Programming thus allows the component tolerances of the integrated circuit and of the external components to be aligned.

To excite the oscillation, it is necessary to apply a short current pulse at the turn-on instant. This task is undertaken by the starter circuit AS, which excites the current mirror circuit with a current pulse of suitable length at the start. Only after this pulse does the comparator K undertake control of the current mirror.

The trimming circuit TS is used to match the current exactly to the components used.

Figure 2:
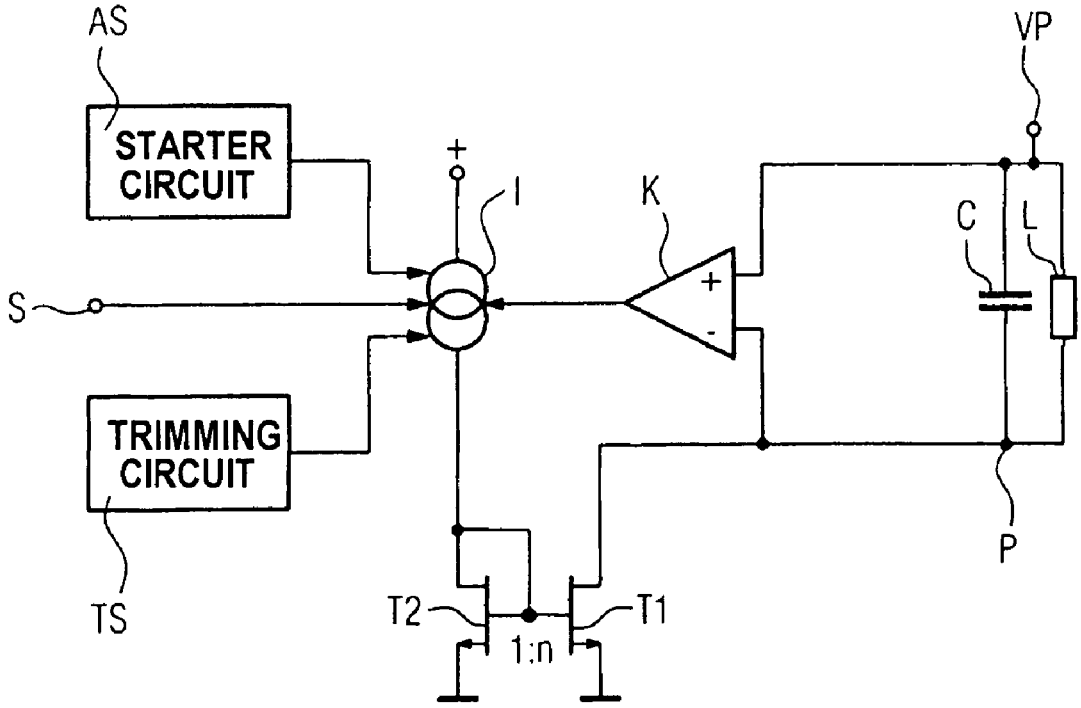
FIG. 2 is a block circuit diagram showing an extended circuit oscillator based on an embodiment of the invention.

A change in the control current I results in a proportional change in the amplitude of the oscillation, which allows corresponding amplitude modulation to be attained. With a suitable modulator circuit for the current 1, the structure can thus be used to generate an AM transmission signal. FIG. 2 indicates an appropriate control input S for the current source I. A control signal S is taken as a basis for varying the current and hence for amplitude-modulating the transmission signal. The rest of the components in the circuit shown in FIG. 2 correspond to those in FIG. 1.

Figure 3:
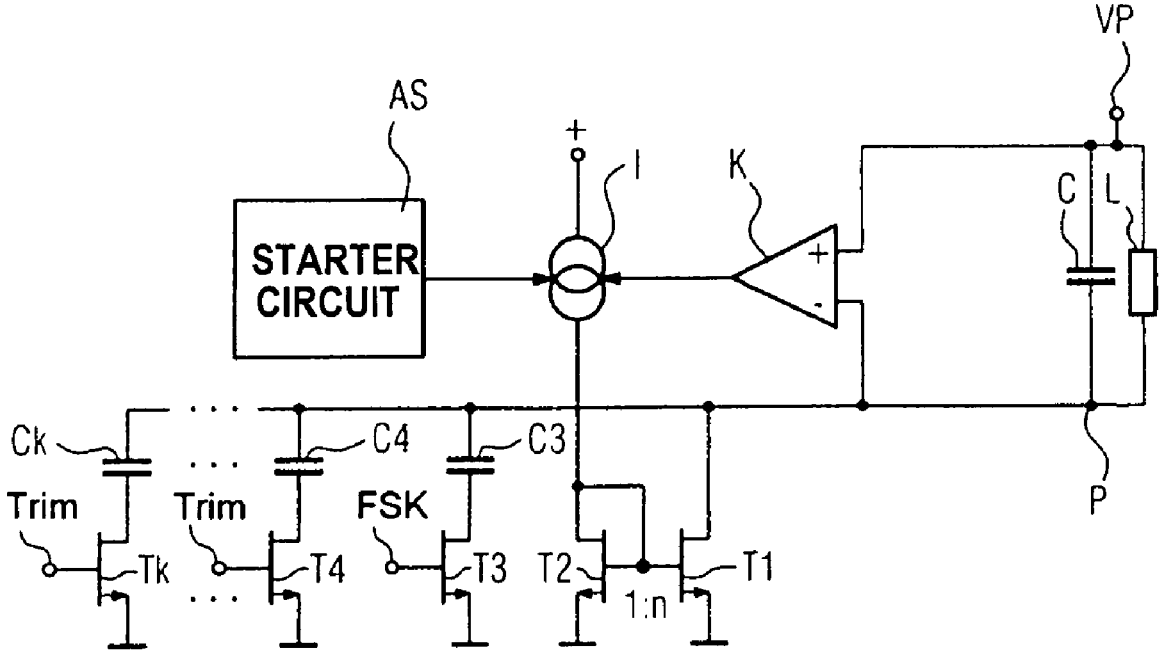
FIG. 3 is a block circuit diagram showing an alternative transmission oscillator.

Another embodiment of the present invention is shown in FIG. 3. This demonstrates a way of changing the transmission frequency by connecting a capacitance C. The resonant frequency of the LC circuit is lowered by a defined value when the transistor T3 is turned on. The transistor 3 is actuated by an FSK signal, which means that modulation in line with "frequency shift keying" can be performed. It is naturally possible for the transistor T3 to be actuated by a different frequency modulation signal.

Suitable connection of trimming capacitors C4 to Ck using switching transistors T4 to Tk also allows the resonant frequency to be trimmed in order to compensate for component tolerances. The switching transistors T3 to Tk and also all trimming capacitors may be integrated on the hearing aid's integrated circuit. Hence, the entire circuit as shown in one of FIGS. 1 to 3 may be integrated on one IC, possibly with the exception of the component L, with the coil L being able to be used as an antenna in an inductive transmission system.

A circuit of the type described above ensures operation at supply voltages which are usual in the hearing aid and also ensures precise and simple setting of the transmission amplitude. Without special circuitry, the maximum transmission amplitude which can be achieved is twice the operating voltage. When suitable voltage increasing circuits are used, higher voltages may also be generated. Preferably, the modulation methods used are AM and FSK. The connectable capacitor elements allow simple tuning of the transmission frequency.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware components configured to perform the specified functions. For example, the present invention may employ various integrated circuit components which may carry out a variety of functions. Furthermore, the present invention could employ any number of conventional techniques for electronics configuration, signal processing and/or control and the like.

The particular implementations shown and described herein are illustrative examples of the invention and are not intended to otherwise limit the scope of the invention in any way. For the sake of brevity, conventional electronics, and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A hearing aid including a data transmission device for hearing aids, comprising:

a modulatable oscillator circuit configured for generating an alterable transmission signal;

said oscillator circuit comprising a coil;

said coil is utilized as an antenna for radiating the transmission signal and for receiving a reception signal; and an actuation circuit having a feed for delivering an adjustable amount of energy into the oscillator circuit exclusively during a negative or positive half-cycle of the oscillation in the oscillator circuit wherein the actuation circuit further comprises a current mirror that is actuated by a comparator circuit that monitors the polarity of the oscillation.

2. The hearing aid as claimed in claim 1, wherein the oscillator circuit comprises an LC resonant circuit.

3. The hearing aid as claimed in claim 1, wherein the actuating current mirror comprises a control to control the transmission power that is to be output and the oscillation amplitude.

4. The hearing aid as claimed in claim 1, wherein the current mirror further comprises an actuation signal configured to help produce an amplitude modulation.

5. The hearing aid as claimed in claim 4, further comprising a modulator circuit that is connected to the oscillator circuit and comprises a connectable capacitor element, configured for frequency modulating an oscillation in the oscillator circuit.

6. The hearing aid as claimed in claim 4, further comprising a trimming device that is connected to the oscillator circuit, configured for trimming the resonant frequency of the oscillator circuit.

7. The hearing aid as claimed in claim 1, further comprising a modulator circuit that is connected to the oscillator circuit and comprises a connectable capacitor element, configured for frequency modulating an oscillation in the oscillator circuit.

8. The hearing aid as claimed in claim 1, further comprising a trimming device that is connected to the oscillator circuit, configured for trimming the resonant frequency of the oscillator circuit.

9. The hearing aid as claimed in claim 8, wherein the trimming device comprises one or more connectable capacitors.

* * * * *